US011219103B2

(12) United States Patent
Huang et al.

(10) Patent No.: US 11,219,103 B2
(45) Date of Patent: Jan. 4, 2022

(54) METHOD, APPARATUS AND DEVICE OF LED DIMMING, AND STORAGE MEDIUM

(71) Applicant: GUANGZHOU YAJIANG PHOTOELECTRIC EQUIPMENT CO., LTD., Guangdong (CN)

(72) Inventors: Rongfeng Huang, Guangdong (CN); Zhiman Chen, Guangdong (CN); Yunchou Chen, Guangdong (CN)

(73) Assignee: GUANGZHOU YAJIANG PHOTOELECTRIC EQUIPMENT CO., LTD., Guangzhou (CN)

( * ) Notice: Subject to any disclaimer, the term of this patent is extended or adjusted under 35 U.S.C. 154(b) by 390 days.

(21) Appl. No.: 16/341,919

(22) PCT Filed: Apr. 24, 2018

(86) PCT No.: PCT/CN2018/084191
§ 371 (c)(1),
(2) Date: Apr. 14, 2019

(87) PCT Pub. No.: WO2019/184037
PCT Pub. Date: Oct. 3, 2019

(65) Prior Publication Data

US 2021/0251058 A1 Aug. 12, 2021

(30) Foreign Application Priority Data

Mar. 30, 2018 (CN) ..... 201810287363.6

(51) Int. Cl.
*H05B 45/10* (2020.01)
*H05B 45/325* (2020.01)
(Continued)

(52) U.S. Cl.
CPC ..... *H05B 45/10* (2020.01); *H05B 45/14* (2020.01); *H05B 45/325* (2020.01)

(58) Field of Classification Search
CPC ..... H05B 45/10; H05B 45/14; H05B 45/325; G09G 3/2007; G09G 2320/0673;
(Continued)

(56) References Cited

U.S. PATENT DOCUMENTS

2007/0247407 A1* 10/2007 Lee ..... G09G 3/2007 345/89
2012/0019160 A1* 1/2012 Lee ..... H05B 45/10 315/291

FOREIGN PATENT DOCUMENTS

CN 106714383 A 5/2017
TW 200741639 A 11/2007

* cited by examiner

*Primary Examiner* — Thai Pham

(57) ABSTRACT

A LED dimming method includes obtaining an illumination set according to a preset dimming curve and an initial dimming grayscale set; obtaining an excitation signal set comprising a voltage signal set or a current signal set according to the illumination set; obtaining a measured illumination curve according to the excitation signal set and the initial dimming grayscale set; collecting a subdivision dimming grayscale set according to the measured illumination curve and the preset dimming curve, so that a dimming curve corresponding to the subdivided dimming grayscale set and the illumination set coincides with the preset dimming curve; and adjusting the excitation signal set according to the subdivision dimming grayscale set. The method can achieve an ideal and undistorted optical curve effect to meet the demands of the user, and therefore achieving an efficient and accurate dimming.

5 Claims, 6 Drawing Sheets

(51) Int. Cl.
*G09G 3/34* (2006.01)
*H05B 45/14* (2020.01)

(58) Field of Classification Search
CPC ..... G09G 2360/145; G09G 5/10; G09G 3/32;
G09G 3/3208; G09G 3/34; G09G 3/3426
See application file for complete search history.

METHOD, APPARATUS AND DEVICE OF LED DIMMING, AND STORAGE MEDIUM

FIELD OF THE INVENTION

The present invention relates to LED dimming and, more particularly to a method, an apparatus, and a device of LED dimming, and a storage medium.

BACKGROUND OF THE INVENTION

In order to make the lighting and dimming effect of the lamp more suitable for people's sensory requirements, a variety of dimming curves are designed to meet the visual requirements of optical changes, such as Line curve, S curve, Square curve, i-Square curve, or a λ curve that can be freely adjusted, as shown in FIG. 1 below.

FIG. 1 is a theoretical curve waveform that is calculated under ideal conditions. According to the illumination principle of the light source, the light source is generally driven by voltage or current, and the signal of control voltage or current can be designed into an ideal curve state. But the light effect of the light source is nonlinear, and the luminous efficiency is different under different powers, which finally causes the light to deviate from the theoretical value, and the directions of the deviation caused by the difference in the characteristics of the different light sources are also different. At the same time, there are differences in the driving circuit itself, which also affects the linearity of the voltage or current. Referring to FIG. 2, the dashed line indicates the measured dimming curve, and the solid line indicates the preset dimming curve.

Distorted optical dimming curve is undesirable, as it directly affects the sensory effect of dimming and lighting. Further in the color LED products, there are LED light sources of various colors such as red, green, blue and white, the luminous efficiency is different for different color light sources, and the position and direction of the dimming curve deviating from the theoretical curve are also different. Therefore, color drift occurs when color mixing is performed with different powers or different ratios of brightness.

SUMMARY OF THE INVENTION

In view of the above deficiencies, the technical problem of the present disclosure is to provide a LED dimming method, which makes the actual dimming curve coincide with the theoretical curve, thereby dimming illumination efficiently and accurately.

As a first aspect of the present disclosure, a LED dimming method includes:

obtaining an illumination set according to a preset dimming curve and an initial dimming grayscale set;

obtaining an excitation signal set according to the illumination set, and the excitation signal set comprising a voltage signal set or a current signal set;

obtaining a measured illumination curve according to the excitation signal set and the initial dimming grayscale set;

collecting a subdivision dimming grayscale set according to the measured illumination curve and the preset dimming curve, so that a dimming curve corresponding to the subdivided dimming grayscale set and the illumination set coincides with the preset dimming curve; and adjusting the excitation signal set according to the subdivision dimming grayscale set.

As a first embodiment according to the first aspect of the present disclosure, before collecting a subdivision dimming grayscale set according to the measured illumination curve and the preset dimming curve, the LED dimming method further includes:

scaling up the measured illumination curve to a maximum such that a maximum illumination value of the measured illumination curve coincides with a maximum illumination value of the preset dimming curve;

wherein said collecting a subdivision dimming grayscale set according to the measured illumination curve and the preset dimming curve includes:

subdividing each gray value of the measured illumination curve such that each of the gray values is an integer value; and obtaining the subdivision dimming grayscale set corresponding to the gray value that is subdivided, so that the dimming curve corresponding to the subdivided dimming grayscale set and the illumination set coincides with the preset dimming curve.

As a second embodiment according to the first aspect of the present disclosure, said subdividing each gray value of the measured illumination curve such that each of the gray values is an integer value includes:

obtaining an upgrade level of the gray value; and upgrading a grayscale of the gray value according to the upgrade level.

As a third embodiment according to the first aspect of the present disclosure, said subdividing each gray value of the measured illumination curve such that each of the gray values is an integer value further includes:

adding a fine adjustment value to the gray value that has been upgraded, with a range of the fine adjustment value from 0 to 255.

As a fourth embodiment according to the first aspect of the present disclosure, said adjusting the excitation signal set according to the subdivision dimming grayscale set includes:

adjusting a pulse width signal level of the excitation signal set according to the upgrade level; and proportionally adjusting the excitation signal set according to the pulse width signal.

As a fifth embodiment according to the first aspect of the present disclosure, said obtaining a measured illumination curve according to the excitation signal set and the initial dimming grayscale set includes:

obtaining the illumination set collected by an illuminometer when the excitation signal set is inputted; and obtaining the measured illumination curve according to the illumination set and a preset grayscale set.

As a sixth embodiment according to the first aspect of the present disclosure, said obtaining an excitation signal set according to the illumination set includes:

obtaining a relationship between the illumination set that is pre-stored and the excitation signal set; and obtaining the excitation signal set according to the illumination set and the relationship between the illumination set that is pre-stored and the excitation signal set and the excitation signal set.

As a second aspect of the present disclosure, a LED dimming apparatus includes:

an illumination set obtaining module, adapted for obtaining an illumination set according to a preset dimming curve and an initial dimming grayscale set;

an excitation signal set obtaining module, adapted for obtaining an excitation signal set according to the illumination set, and the excitation signal set comprising a voltage signal set or a current signal set;

a measured illumination curve obtaining module, adapted for obtaining a measured illumination curve according to the excitation signal set and the initial dimming grayscale set;

a subdivision dimming grayscale set obtaining module, adapted for collecting a subdivision dimming grayscale set according to the measured illumination curve and the preset dimming curve, so that a dimming curve corresponding to the subdivided dimming grayscale set and the illumination set coincides with the preset dimming curve; and an excitation signal set adjusting module, adapted for adjusting the excitation signal set according to the subdivision dimming grayscale set.

As a third aspect of the present disclosure, a LED dimming device includes a processor, a memory, and computer programs stored in the memory and configured to be executed by the processor, wherein the LED dimming method mentioned above is achieved when the processor executes the computer programs.

As a fourth aspect of the present disclosure, a computer readable storage medium, comprising computer programs stored therein, wherein the LED dimming method mentioned above is performed by a device to which the computer readable storage medium pertains when the computer programs are run.

The above technical solution has the following advantages: an illumination set is obtained according to a preset dimming curve and an initial dimming grayscale set, and a corresponding excitation signal set is obtained according to the illumination set, so that a measured illumination curve can be obtained according to the excitation signal set and the initial dimming grayscale set. And then, a subdivision dimming grayscale set is collected according to the measured illumination curve and the preset dimming curve, so that a dimming curve corresponding to the subdivided dimming grayscale set and the illumination set coincides with the preset dimming curve; and finally the LED lamp can be adjusted since the excitation signal set can be adjusted according to the subdivided dimming grayscale set, that is, the measured dimming curve is adjustable according to the preset ideal dimming curve, so that the illumination set can be located at the preset dimming curve after the excitation signal set is inputted, thereby achieving an ideal and undistorted optical curve effect to meet the demands of the user, and therefore achieving an efficient and accurate dimming.

DETAILED DESCRIPTION OF ILLUSTRATED EMBODIMENTS

A distinct and full description of the technical solution of the present disclosure will follow by combining with the accompanying drawings. By all appearances, the embodiments to be described just are a part of embodiments of the present disclosure, not the all. Based on the embodiment of the present disclosure, all other embodiments obtained by the person ordinarily skilled in the art without any creative work pertain to the protection scope of the present disclosure.

The present disclosure provides a LED dimming method which is adapted for achieving idealized and undistorted optical curve effect. Following is the detailed description.

Figure 1:
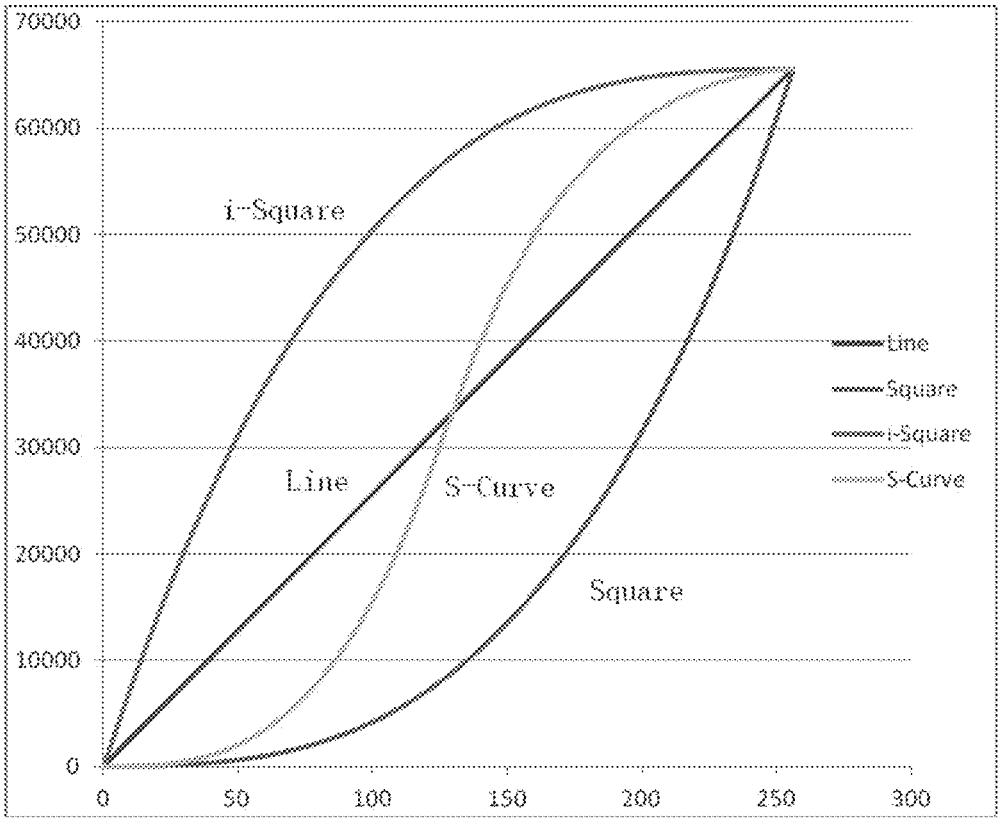
FIG. 1 is an ideal dimming curve in the prior art.
Figure 2:
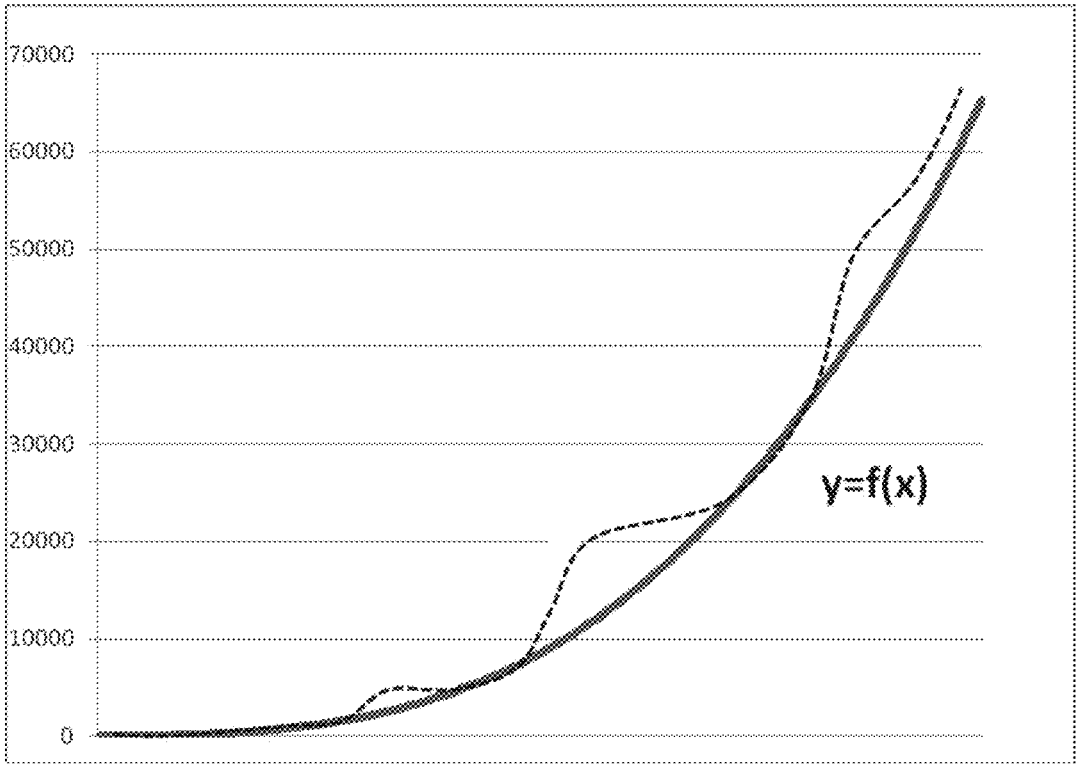
FIG. 2 is a comparison charts between the ideal dimming curve in the prior art and the measured dimming curve.
Figure 3:
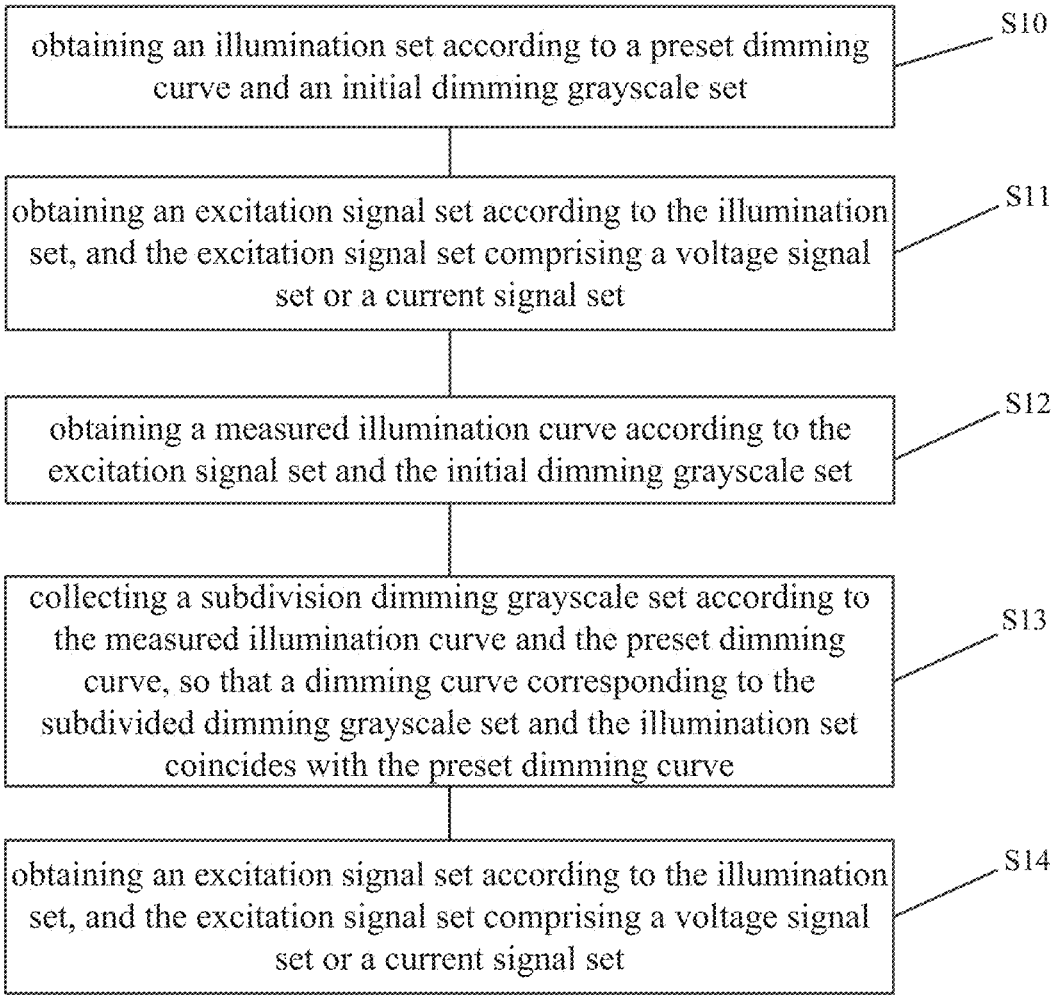
FIG. 3 is a flowchart of a LED dimming method according to a first embodiment of the present disclosure.

Referring to FIG. 3 showing a flowchart of a LED dimming method according to a first embodiment of the present disclosure, the method is executed by a dimmer and includes the following steps:

S10, obtaining an illumination set according to a preset dimming curve and an initial dimming grayscale set.

In this embodiment, the dimmer can be a LED dimming driver, which is not limited here.

In this embodiment, the dimmer can pre-store the preset dimming curve, the initial dimming grayscale set, the relationship between the illumination set and the excitation signal set, and the relationship between the subdivision dimming grayscale set and the excitation signal set, which is not limited here.

In this embodiment, each gray value of the initial set dimming grayscale set ranges from 0 to 255, preferably is an 8-bit value.

In this embodiment, the preset dimming curve can be chosen by users, preferably is a dimming curve in ideal status, which is not limited here.

Figure 4:
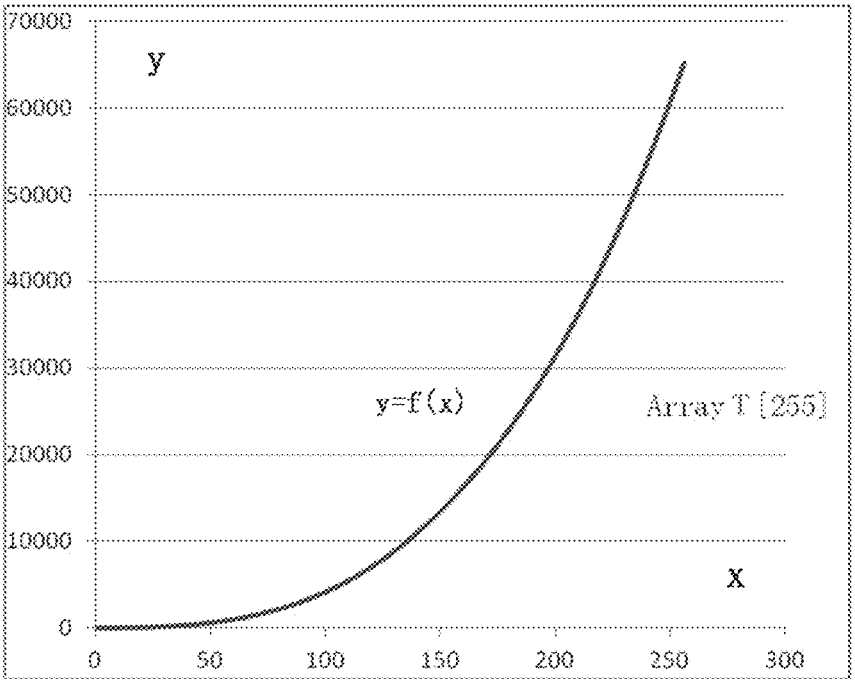
FIG. 4 is a preset dimming curve provided by the present embodiment.

Specifically, the preset dimming curve equation is $y=f(x)$, y is an illumination value, x is the dimming gray value, and the effective range illumination value $y \in (0, Ymax)$, dimming gray value $x \in (0, 255)$, the gray value x is an 8-bit value, and each gray value Xn has a unique illumination value Yn which is one-to-one, so that a definite optical curve is established. Referring to FIG. 4, the illumination value y corresponding to each gray value x of the dimming curve equation $y=f(x)$ is calculated, and thus the illumination set $T[255]=\{Y0, Y1, Y2, \ldots Ymax\}$ is established. While the curve composed of the illumination set T[255] is the preset dimming curve.

S11, obtaining an excitation signal set according to the illumination set, and the excitation signal set comprising a voltage signal set or a current signal set.

It should be noted that, the illumination of the LED light source increases linearly as the operating current increases. In practical applications, the illumination of the LED light source can be adjusted by changing the operating current or operating voltage as needed. Specifically, the illumination of the LED lamp increases as the operating current increases. That is, for the same LED light source, the larger the operating current is, the greater the current density injected into the active area of the LED generates, so that the more carriers that can participate in luminescence, and the illumination of the LED is greater. Therefore, in the embodiment of the present disclosure, the LED illumination can be approximately considered to be in a proportional relationship with the input current or the input voltage, and the optical illumination output can be adjusted by the input current and the input voltage of the LED.

Preferably, the step of obtaining the excitation signal set according to the illumination set includes steps of:

S21, obtaining a relationship between the illumination set that is pre-stored and the excitation signal set;

S22, obtaining the excitation signal set according to the illumination set and the relationship between the illumination set that is pre-stored and the excitation signal set and the excitation signal set.

In this embodiment, since the illumination set is obtained in the step of S10, thus the corresponding excitation signal can be deduced according to relationship between the illumination set and the excitation signal set.

Specifically, taking the excitation signal as a current signal as an example, each illumination value corresponds to a corresponding excitation signal value, assuming that 0-100% current control is to be performed on the LED lamp, with corresponding illumination values matching with the 0-100% current control. Thus it's necessary to us PWM single to control the dimming driver, so as to achieve a linear current output in the same proportion as the PWM signal, and such a linear current set is obtained as the corresponding excitation signal set. That is, the PWM duty cycle dimming algorithm is used to adjust the excitation signal output in equal proportions, thereby realizing the conversion of the theoretical dimming curve into a corresponding proportional current signal. The acquisition of the corresponding voltage signal set is the same as the acquisition of the current signal set, and details are not described herein again.

S12, obtaining a measured illumination curve according to the excitation signal set and the initial dimming grayscale set.

Preferably, the step S12 specifically includes:

obtaining the illumination set collected by an illuminometer when the excitation signal set is inputted; and obtaining the measured illumination curve according to the illumination set and a preset grayscale set.

Specifically, the preset grayscale set namely 0-255 groups of grey values are inputted, so the illumination value M for each gray value can be measured out, which forms a group of illumination values M[255]={M0, M1, M2, . . . M max}, and meanwhile the illumination valve set collected by the illuminometer is obtained, so that the measured illumination curve can be obtained according to the illumination valve set and the preset grayscale set.

S13, collecting a subdivision dimming grayscale set according to the measured illumination curve and the preset dimming curve, so that a dimming curve corresponding to the subdivided dimming grayscale set and the illumination set coincides with the preset dimming curve.

In this embodiment, when performing the re-acquisition of the dimming grayscale set, all the dimming grays are collected according to the measured illumination curve on the premise that the illumination set is determined, and then the subdivided dimming grayscale set is collected. The purpose is to make the dimming curved formed by the subdivided dimming grayscale set and the illumination set coincide with the preset dimming curve, and it's necessary adjust the corresponding gray value and the illumination value on the shifted preset dimming curve, so that gray values and the illumination value fall on the preset dimming curve.

Figure 5:
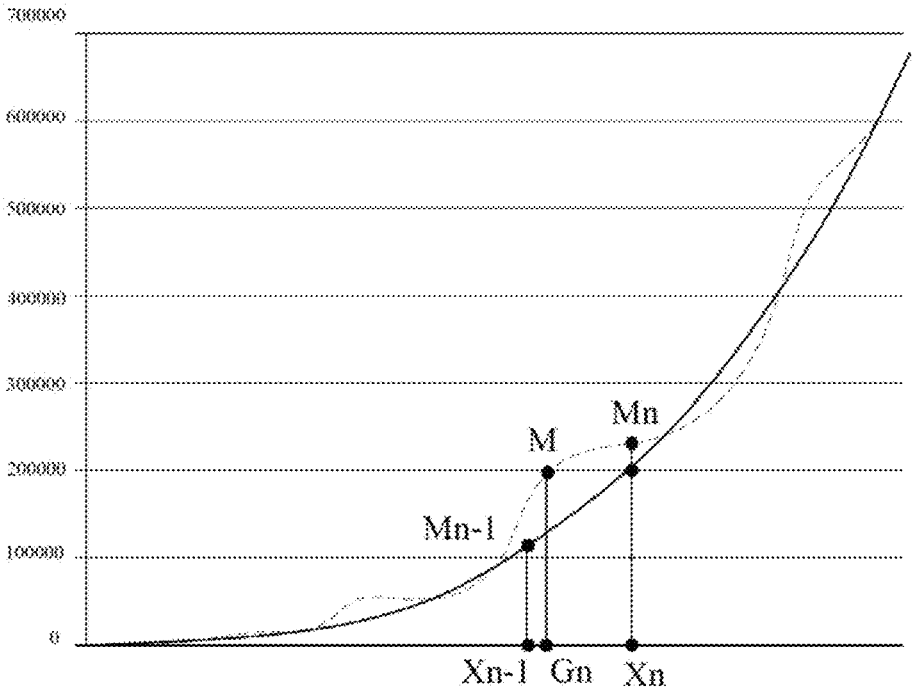
FIG. 5 is a chart for checking gray for the ideal dimming curve and the measured dimming curve.

Specifically, referring to FIG. 5, in which the dashed line indicates a measured dimming curve and the solid line indicates a preset dimming curve. Taking the illumination value of 20000 as an example, the illumination value of 20000 is on the preset dimming curve Yn. While the illumination value of 20000 is on the measured dimming curve M, with a corresponding gray value is Gn between Xn−1 and Xn, thus the gray value Gn is shifted or subdivided, so that the value M coincides with the value Yn, and finally, the gray values after shifted or subdivided are collected, which is not limited here.

S14, adjusting the excitation signal set according to the subdivision dimming grayscale set.

In this embodiment, the excitation signal set is adjusted so that the actual illumination value can coincide with the said illumination value, thereby the dimming curved corresponding to the subdivided dimming grayscale set and the illumination set can coincide with the preset dimming curve.

Specifically, assuming that the subdivided dimming grayscale set is upgraded, and the 8-bit gray value is upgraded to a 16-bit gray value, the PWM control signal of the original excitation signal set is assumed to be 8 bits, and the PWM control signal is amplified to 16 bits, and the 16-bit PWM control signal is controlled to adjust the LED current or voltage proportionally. If the subdivided dimming grayscale set is shifted, such as a certain gray value Gn is shifted left, the offset value is obtained, and the scaling can be calculated accordingly, so that the PWM control signal value is reduced proportionally; if the gray value Gn is shifted left, the offset value is obtained, and the scaling can be calculated accordingly, the PWM control signal value is increased proportionally.

The embodiment has the following advantages: in this embodiment, an illumination set is obtained according to a preset dimming curve and an initial dimming grayscale set, and a corresponding excitation signal set is obtained according to the illumination set, so that a measured illumination curve can be obtained according to the excitation signal set and the initial dimming grayscale set. And then, a subdivision dimming grayscale set is collected according to the measured illumination curve and the preset dimming curve, so that a dimming curve corresponding to the subdivided dimming grayscale set and the illumination set coincides with the preset dimming curve; and finally the LED lamp can be adjusted since the excitation signal set can be adjusted according to the subdivided dimming grayscale set, that is, the measured dimming curve is adjustable according to the preset ideal dimming curve, so that the illumination set can be located at the preset dimming curve after the excitation signal set is inputted, thereby achieving an ideal and undistorted optical curve effect to meet the demands of the user, and therefore achieving an efficient and accurate dimming. Of course, implementing any of the products of the present disclosure does not necessarily require all of the advantages described above to be achieved at the same time.

Figure 6:
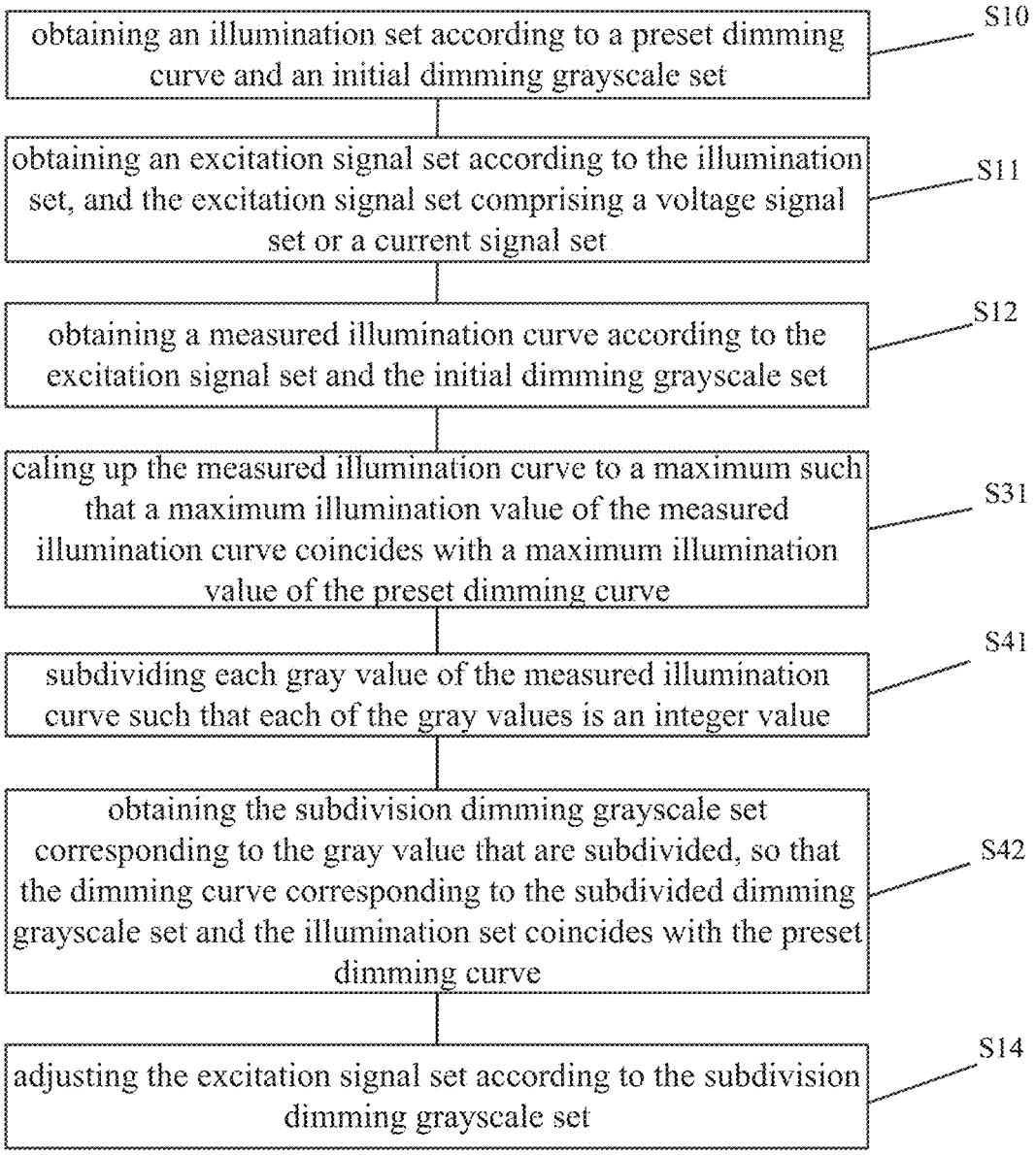
FIG. 6 is a flowchart of a LED dimming method according to a second embodiment of the present disclosure.

Referring to FIG. 6, preferably, before collecting a subdivision dimming grayscale set according to the measured illumination curve and the preset dimming curve, the method further includes the following steps:

S31, scaling up the measured illumination curve to a maximum such that a maximum illumination value of the measured illumination curve coincides with a maximum illumination value of the preset dimming curve.

Specifically, the measured dimming curve M[255] is scaled by a proportion $\eta$=Ymax/Mmax, wherein the Mmax is the maximum gray value in the measured dimming curve, and the Ymax is the maximum illumination value of the preset dimming curve, making the maximum illumination value of the measured illumination curve and the maximum illumination value of the preset dimming curve be equal to Ymax, thereby forming a normalized illumination curve U[255]={M0**$\eta$, M1*$\eta$, M2*$\eta$, . . . Mmax*$\eta$}, with the maximum illumination value equal to Ymax. If a gray value $x \in (0,255)$ is inputted, $y \in (0,Ymax)$ is calculated accordingly. If the value Ymax=65535, that is the maximum illumination value of y=f(x) is 65535, while Mmax=255, thus η=Y max/M max=65535/255=257. Therefore the measured illumination curve M[255] is scaled by the proportion η=Ymax/Mmax=257 to form a normalized illumination curve U[255] whose maximum illumination value is equal to Ymax. The purpose of the normalized illumination curve is to ensure that the maximum values are the same, so as to prepare the measured dimming curve M[255] to be adjusted with the preset dimming curve equation y=f(x), and improve the accuracy of gray value offset or subdivision.

Said collecting a subdivision dimming grayscale set according to the measured illumination curve and the preset dimming curve includes step of:

S41, subdividing each gray value of the measured illumination curve such that each of the gray values is an integer value.

Figure 8:
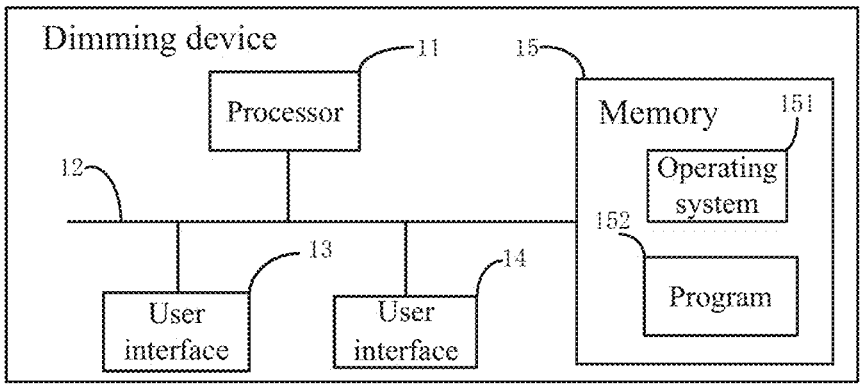
FIG. 8 is a schematic view of a LED dimming device according to a fourth embodiment of the present disclosure.

It should be noted that, when the illumination value Yn is inputted, the corresponding gray value Gn can be determined on the normalized illumination curve U[255]. However, the gray value Gn may not an integer value, but between two integer values since the normalized illumination curve U[255] may deviate from the theoretical illumination curve y=f(x). As illustrated in FIG. 8, the gray value is between Xn−1 and Xn, thus it's necessary to subdivide the gray value to make it be an integer value.

S42, obtaining the subdivision dimming grayscale set corresponding to the gray value that are subdivided, so that the dimming curve corresponding to the subdivided dimming grayscale set and the illumination set coincides with the preset dimming curve.

Preferably, said subdividing each gray value of the measured illumination curve such that each of the gray values is an integer value includes:

S401, obtaining an upgrade level of the gray value.

In this embodiment, the original gray value is an 8-bit value, if a 16-bit value is desired, then the upgrade level is 8.

S402, upgrading a grayscale of the gray value according to the upgrade level.

Preferably, said subdividing each gray value of the measured illumination curve such that each of the gray values is an integer value further includes:

S403, adding a fine adjustment value to the gray value that has been upgraded, with a range of the fine adjustment value from 0 to 255.

Specifically, assuming that the original gray value is an 8-bit value, the gray value Gn is subdivided into 16-bit values, which are represented by two bits, such as Gn [D, uD], where D is a gray integer, and the value is enlarged by 255 times, then D E (0,65535), and uD is the trimming value uD ∈ (0,255) between two adjacent integers. A two-dimensional array of mapped grayscales is generated from the gray value x ∈ (0, 255), wherein the gray value of the LED dimming is enlarged from the original 8 bits to 16 bits, so that each gray value can be subdivided into 255 values.

```
G[255][2]={{D0, uD0},
           {D1, uD1},
           {D2, uD2},
           {D3, uD3},
           ....
           {D255, uD255},
};
```

For example, for the gray group G[35]={ 8925, 47}, and its value G[35]=8925+47=8972, that is, the gray value of the gray G[35] after 16-bit subdivision is 8972. In such a way, a grayscale mapping equation G=f(x) is established, which is determined by the value of the grayscale two-dimensional array G[255][2].

In this embodiment, the initial diming grayscale is converted into a subdivided dimming grayscale set, that is, a grayscale two-dimensional array, and the X-axis of the dimming curve is subdivided; a gray value and the illumination value are definite, while the gray value is determined by the value of the grayscale two-dimensional array G[255][2]. That is, the values on the X axis of the dimming curve are subdivided, so that the dimming curve according to the subdivision grayscale set and the illumination set coincides with the preset dimming curve.

Preferably, said adjusting the excitation signal set according to the subdivision dimming grayscale set includes:

S51, adjusting a pulse width signal level of the excitation signal set according to the upgrade level; and

S52, proportionally adjusting the excitation signal set according to the pulse width signal.

In this embodiment, if the original gray value is an 8-bit value which is upgraded to a 16-bit value, the PWM control signal is also upgraded from an 8-bit value to a 16-bit value, and the excitation signal is adjusted proportionally by the PWM.

The embodiment has the following advantages: in this embodiment, an illumination set is obtained according to a preset dimming curve and an initial dimming grayscale set, and a corresponding excitation signal set is obtained according to the illumination set, so that a measured illumination curve can be obtained according to the excitation signal set and the initial dimming grayscale set. And then, a subdivision dimming grayscale set is collected according to the measured illumination curve and the preset dimming curve, so that a dimming curve corresponding to the subdivided dimming grayscale set and the illumination set coincides with the preset dimming curve; and finally the LED lamp can be adjusted since the excitation signal set can be adjusted according to the subdivided dimming grayscale set, that is, the measured dimming curve is adjustable according to the preset ideal dimming curve, so that the illumination set can be located at the preset dimming curve after the excitation signal set is inputted, thereby achieving an ideal and undistorted optical curve effect to meet the demands of the user, and therefore achieving an efficient and accurate dimming. Of course, implementing any of the products of the present disclosure does not necessarily require all of the advantages described above to be achieved at the same time.

Figure 7:
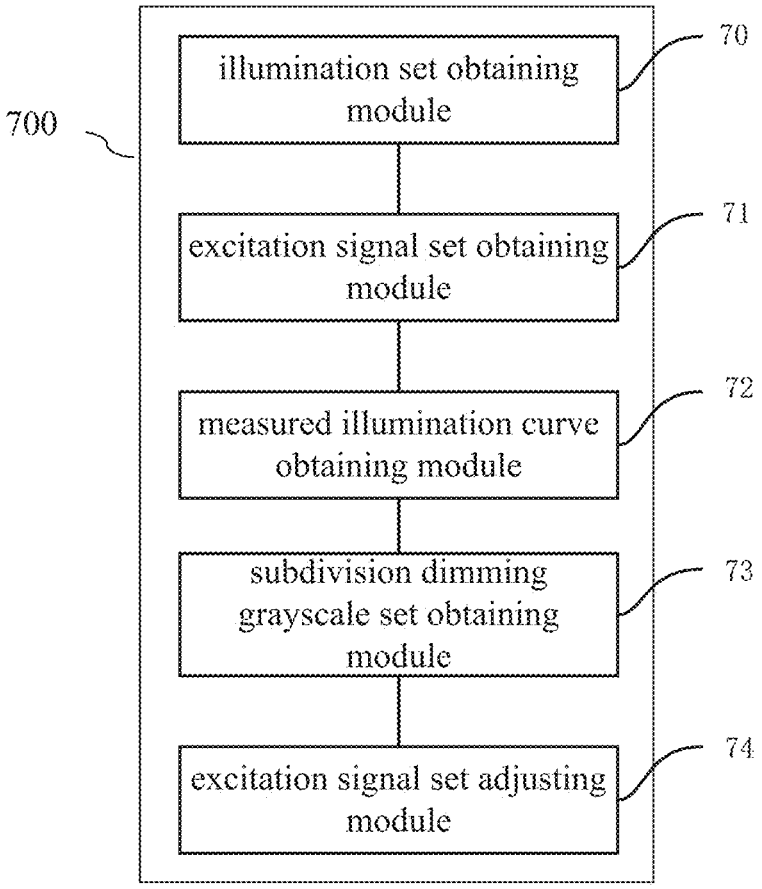
FIG. 7 is a schematic view of a LED dimming apparatus according to a third embodiment of the present disclosure.

Referring to FIG. 7, it shows a LED dimming apparatus according to the present disclosure. Specifically, the LED dimming device includes:

an illumination set obtaining module 70, adapted for obtaining an illumination set according to a preset dimming curve and an initial dimming grayscale set;

an excitation signal set obtaining module 71, adapted for obtaining an excitation signal set according to the illumination set, and the excitation signal set comprising a voltage signal set or a current signal set;

a measured illumination curve obtaining module 72, adapted for obtaining a measured illumination curve according to the excitation signal set and the initial dimming grayscale set;

a subdivision dimming grayscale set obtaining module 73, adapted for collecting a subdivision dimming grayscale set according to the measured illumination curve and the preset dimming curve, so that a dimming curve corresponding to the subdivided dimming grayscale set and the illumination set coincides with a preset dimming curve; and an excitation signal set adjusting module 74, adapted for adjusting the excitation signal set according to the subdivision dimming grayscale set.

Preferably, the apparatus further includes:

a scaling unit, adapted for zooming the measured illumination curve to a maximum scale such that a maximum illumination value of the measured illumination curve coincides with a maximum illumination value of the preset dimming curve.

Specifically, the subdivision dimming grayscale set obtaining module 73 includes:

a subdivision unit, adapted for subdividing each gray value of the measured illumination curve such that each of the gray values is an integer value; and a subdivision dimming grayscale set obtaining unit, adapted for obtaining the subdivision dimming grayscale set corresponding to the gray value that are subdivided, so that the dimming curve corresponding to the subdivided dimming grayscale set and the illumination set coincides with the preset dimming curve.

Preferably, the subdivision unit includes:

an upgrade level obtaining unit, adapted for obtaining an upgrade level of the gray value; and an upgrading unit, adapted for upgrading a grayscale of the gray value according to the upgrade level.

More preferably, the subdivision unit further includes:

an adding unit, adapted for adding a fine adjustment value to the gray value that has been upgraded, with a range of the fine adjustment value from 0 to 255.

Preferably, the excitation signal set adjusting module 74 includes:

an adjusting unit, adapted for adjusting a pulse width signal level of the excitation signal set according to the upgrade level; and an excitation signal set adjusting unit, adapted for proportionally adjusting the excitation signal set according to the pulse width signal.

Preferably, the measured illumination curve obtaining module 72 includes:

an illumination set collection unit, obtaining the illumination set collected by an illuminometer when the excitation signal set is inputted; and a measured illumination curve obtaining unit, adapted for obtaining the measured illumination curve according to the illumination set and the preset grayscale set.

The embodiment has the following advantages: in this embodiment, an illumination set is obtained according to a preset dimming curve and an initial dimming grayscale set, and a corresponding excitation signal set is obtained according to the illumination set, so that a measured illumination curve can be obtained according to the excitation signal set and the initial dimming grayscale set. And then, a subdivision dimming grayscale set is collected according to the measured illumination curve and the preset dimming curve, so that a dimming curve corresponding to the subdivided dimming grayscale set and the illumination set coincides with the preset dimming curve; and finally the LED lamp can be adjusted since the excitation signal set can be adjusted according to the subdivided dimming grayscale set, that is, the measured dimming curve is adjustable according to the preset ideal dimming curve, so that the illumination set can be located at the preset dimming curve after the excitation signal set is inputted, thereby achieving an ideal and undistorted optical curve effect to meet the demands of the user, and therefore achieving an efficient and accurate dimming. Of course, implementing any of the products of the present disclosure does not necessarily require all of the advantages described above to be achieved at the same time.

Referring to FIG. 8, a dimming apparatus according to the third embodiment for performing the dimming method of the present disclosure includes a processor 11, such as a CPU, at least one network interface 14 or other user interfaces 13, a memory 15, and at least one communication bus 12 for communicating above assemblies one another. Specifically, the user interfaces 13 can include USB interfaces, or other standard interfaces, wired interfaces; the network interfaces 14 can be Wi-Fi interfaces or other wireless interfaces. The memory 15 may include high speed RAM memory, or non-volatile memory, such as at least one disk memory. Optionally, the memory 15 can include a storage device located far away from the processor 11.

In some embodiments, the memory 15 stores the following elements, executable modules or data structures, or subsets thereof, or extension sets thereof:

operating system 151, including various system programs, for implementing various basic services and processing hardware-based tasks; and programs 152.

Specifically, the processor 11 is used for calling programs 152 stored in the memory 15, and implementing the dimming method.

The said processor can be central processing unit (CPU), or other general purpose processors, digital signal processor (DSP), application specific integrated circuit (ASIC), field-programmable gate array (FPGA), or other programmable logic devices, discrete gates or transistor logic devices, discrete hardware components, etc. The general purpose processor may be a microprocessor or other conventional processors, and the processor is the control center of the LED dimming method, adapted for connecting each part of the LED dimming method by using various interfaces and lines.

The memory can be used to store the computer programs and/or modules, the processor implementing the programs by running or executing the computer programs and/or modules stored in the memory, and recalling data stored in the memory, thereby achieving the various functions of the apparatus of LED dimming. The memory may mainly include a storage program area and a storage data area, wherein the storage program area may store an operating system, at least one application (such as a sound playing function, an image playing function, etc.), and the like. The storage data area can store the data created based on the use of the phone (such as audio data, phone book, etc.). In addition, the memory 15 may include a high-speed random access memory, and may also include a non-volatile memory such as a hard disk, a memory, a plug-in hard disk, a smart memory card (SMC), and a secure digital (SD), a flash card, at least one disk storage device, a flash device, or other volatile solid state storage devices.

Specifically, the modules/units integrated of the LED dimming device can be stored in a computer readable storage medium if implemented in the form of a software functional unit and sold or used as a standalone product. Based on such understanding, all or part of the processes in the foregoing embodiments of the present disclosure may also be completed by computer programs. The computer programs may be stored in a computer readable storage medium. The steps of the various method embodiments described above may be implemented when the programs are executed by the processor. The computer programs comprise computer program codes, which may be in the form of source codes, object codes, executable files or some intermediate forms. The computer readable medium may include any entity or device capable of carrying the computer program codes, a recording medium, a USB flash drive, a removable hard disk, a magnetic disk, an optical disk, a computer memory, a read-only memory (ROM), a random access memory (RAM), electrical carrier signals, telecommunications signals, and software distribution media. It should be noted that the content contained in the computer readable medium may be appropriately increased or decreased according to the requirements of legislation and patent practice in a jurisdiction, for example, in some jurisdictions, computer readable media does not include electrical carrier signals and telecommunication signals according to legislation and patent practice.

It should be noted that the device and apparatus described in the above embodiments are merely illustrative, wherein the units described as separate components may or may not be physically separated, and the components displayed as units may or may not be physical, namely the components can be located in one place or distributed to multiple network units. Some or all of the modules may be selected according to actual needs to achieve the purpose of the solution of the embodiment. In addition, in the drawings of the device or apparatus provided by the present disclosure, the connection relationship between the modules indicates that there is a communication connection therebetween, by one or more communication buses or signal lines. Those of ordinary skill in the art can understand and implement without any creative effort.

While the disclosure has been described in connection with what are presently considered to be the most practical and preferable embodiments, it is to be understood that the disclosure is not to be limited to the disclosed embodiments, but on the contrary, is intended to cover various modifications and equivalent arrangements included within the spirit and scope of the disclosure.

It should be noted that, in the above embodiments, the descriptions of the various embodiments are different, and the parts that are not described in detail in a certain embodiment may refer to related descriptions of other embodiments. Secondly, those skilled in the art will also appreciate that the embodiments described in the specification are all preferred embodiments and that the actions and simulations involved are necessarily required by the present disclosure.

What is claimed is:

1. A LED dimming method, comprising:

obtaining an illumination set, by an illumination set obtaining module, according to a preset dimming curve and an initial dimming grayscale set;

obtaining an excitation signal set, by an excitation signal set obtaining module, according to the illumination set, and the excitation signal set comprising a voltage signal set or a current signal set;

obtaining a measured illumination curve, by a measured illumination curve obtaining module, according to the excitation signal set and the initial dimming grayscale set;

collecting a subdivision dimming grayscale set, by a subdivision dimming grayscale set obtaining module, according to the measured illumination curve and the preset dimming curve, so that a dimming curve corresponding to the subdivided dimming grayscale set and the illumination set coincides with the preset dimming curve; and adjusting the excitation signal set, by an excitation signal set adjusting module, according to the subdivision dimming grayscale set;

wherein before collecting a subdivision dimming grayscale set, by a subdivision dimming grayscale set obtaining module, according to the measured illumination curve and the preset dimming curve, further comprising:

scaling up the measured illumination curve to a maximum, by a scaling unit, such that a maximum illumination value of the measured illumination curve coincides with a maximum illumination value of the preset dimming curve;

wherein said collecting a subdivision dimming grayscale set, by a subdivision dimming grayscale set obtaining module, according to the measured illumination curve and the preset dimming curve comprises:

subdividing each gray value of the measured illumination curve, by a subdivision unit, such that each of the gray values is an integer value; and obtaining the subdivision dimming grayscale set corresponding to the gray value that is subdivided, by a subdivision dimming grayscale set obtaining unit, so that the dimming curve corresponding to the subdivided dimming grayscale set and the illumination set coincides with the preset dimming curve;

wherein said subdividing each gray value of the measured illumination curve, by a subdivision unit, such that each of the gray values is an integer value comprises:

obtaining an upgrade level of the gray value, by an upgrade level obtaining unit; and upgrading a grayscale of the gray value, by an upgrading unit, according to the upgrade level;

wherein said subdividing each gray value of the measured illumination curve, by a subdivision unit, such that each of the gray values is an integer value further comprises:

adding a fine adjustment value to the gray value that has been upgraded, by an adding unit, with a range of the fine adjustment value from 0 to 255.

2. The LED dimming method according to claim 1, wherein said adjusting the excitation signal set, by an excitation signal set adjusting module, according to the subdivision dimming grayscale set comprises:

adjusting a pulse width signal level of the excitation signal set, by an adjusting unit, according to the upgrade level; and proportionally adjusting the excitation signal set, by an excitation signal set adjusting unit, according to the pulse width signal.

3. The LED dimming method according to claim 1, wherein said obtaining a measured illumination curve, by a measured illumination curve obtaining module, according to the excitation signal set and the initial dimming grayscale set comprises:

obtaining the illumination set collected by an illuminometer, by an illumination set collection unit, when the excitation signal set is inputted; and obtaining the measured illumination curve, by a measured illumination curve obtaining unit, according to the illumination set and a preset grayscale set.

4. The LED dimming method according to claim 1, wherein said obtaining an excitation signal set, by an excitation signal set obtaining module, according to the illumination set comprises:

obtaining a relationship between the illumination set that is pre-stored and the excitation signal set; and obtaining the excitation signal set according to the illumination set and the relationship between the illumination set that is pre-stored and the excitation signal set.

5. A LED dimming apparatus, comprising:

an illumination set obtaining module, configured to obtain an illumination set according to a preset dimming curve and an initial dimming grayscale set;

an excitation signal set obtaining module, configured to obtain an excitation signal set according to the illumination set, and the excitation signal set comprising a voltage signal set or a current signal set;

a measured illumination curve obtaining module, configured to obtain a measured illumination curve according to the excitation signal set and the initial dimming grayscale set;

a subdivision dimming grayscale set obtaining module, configured to collect a subdivision dimming grayscale set according to the measured illumination curve and the preset dimming curve, so that a dimming curve corresponding to the subdivided dimming grayscale set and the illumination set coincides with the preset dimming curve; and an excitation signal set adjusting module, configured to adjust the excitation signal set according to the subdivision dimming grayscale set;

wherein the apparatus further comprises:

a scaling unit, configured to zoom the measured illumination curve to a maximum scale such that a maximum illumination value of the measured illumination curve coincides with a maximum illumination value of the preset dimming curve;

wherein the subdivision dimming grayscale set obtaining module further comprises:

a subdivision unit, configured to subdivide each gray value of the measured illumination curve such that each of the gray values is an integer value;

a subdivision dimming grayscale set obtaining unit, configured to obtain the subdivision dimming grayscale set corresponding to the gray value that is subdivided, so that the dimming curve corresponding to the subdivided dimming grayscale set and the illumination set coincides with the preset dimming curve;

wherein the subdivision unit further comprises:

an upgrade level obtaining unit, configured to obtain an upgrade level of the gray value;

an upgrading unit, configured to upgrade a grayscale of the gray value according to the upgrade level;

an adding unit, configured to add a fine adjustment value to the gray value that has been upgraded, with a range of the fine adjustment value from 0 to 255.

* * * * *